US007174917B2

(12) United States Patent
Block et al.

(10) Patent No.: US 7,174,917 B2
(45) Date of Patent: Feb. 13, 2007

(54) INLET PIECE FOR A LIQUID-INJECTED COMPRESSOR ELEMENT

(75) Inventors: Tom Paul Maria Block, Antwerp (BE); Manuel Paula Albert Vandevoorde, Bornem (BE)

(73) Assignee: Atlas Copco Airpower, ñaamloze vennootschap, Wilrijk (BE)

( * ) Notice: Subject to any disclaimer, the term of this patent is extended or adjusted under 35 U.S.C. 154(b) by 165 days.

(21) Appl. No.: 10/523,791

(22) PCT Filed: Jul. 24, 2003

(86) PCT No.: PCT/BE03/00128

§ 371 (c)(1),
(2), (4) Date: Feb. 9, 2005

(87) PCT Pub. No.: WO2004/020833

PCT Pub. Date: Mar. 11, 2004

(65) Prior Publication Data

US 2005/0279416 A1 Dec. 22, 2005

(30) Foreign Application Priority Data

Aug. 29, 2002 (BE) ..... 2002/0505

(51) Int. Cl.
*F15C 1/16* (2006.01)
*F04C 18/16* (2006.01)

(52) U.S. Cl. ..... 137/811; 137/812; 418/181; 418/201.1

(58) Field of Classification Search ..... 137/808, 137/811, 812; 418/181, 201.1
See application file for complete search history.

(56) References Cited

U.S. PATENT DOCUMENTS

| | | | | |
|---|---|---|---|---|
| 3,461,897 | A * | 8/1969 | Kwok | 137/809 |
| 3,515,158 | A * | 6/1970 | Utz | 137/812 |
| 3,712,321 | A * | 1/1973 | Bauer | 137/812 |
| 3,885,931 | A * | 5/1975 | Schaller | 95/269 |
| 4,197,869 | A * | 4/1980 | Moncrieff-Yeates | 137/13 |
| 5,120,207 | A | 6/1992 | Soderlund | |
| 5,303,782 | A * | 4/1994 | Johannessen | 137/809 |
| 5,651,392 | A * | 7/1997 | Essirard | 137/809 |
| 2002/0048521 | A1 | 4/2002 | Achtelik et al. | |

FOREIGN PATENT DOCUMENTS

WO 01/90580 A1 11/2001

* cited by examiner

*Primary Examiner*—A. Michael Chambers
(74) *Attorney, Agent, or Firm*—Bacon & Thomas, PLLC

(57) ABSTRACT

Inlet piece for a liquid-injected compressor element, characterized in that it comprises a sleeve (8) which consists of a casing (11), a bottom wall (12) provided with an opening (13) and a top wall (14) which is entirely tight, a pipe (9) opening on the inside of the sleeve (8) and a partition (10) comprising a span part (15) which spans the opening (13) in the aforesaid bottom wall (12) and which transforms into an inclosing part (16) reaching down to the bottom wall (13), whereby the partition (10) leaves a passage (18) on one side of the opening (13) and the pipe (9) opens in the sleeve (8) between the top wall (14) and the span part (15), such that, because of the partition (10), gas flowing from the opening (13) to the pipe (9) has to make among others a revolving movement.

15 Claims, 3 Drawing Sheets

INLET PIECE FOR A LIQUID-INJECTED COMPRESSOR ELEMENT

The present invention concerns an inlet piece for a liquid-injected compressor element.

When a compressor element is brought to a standstill, air or another gas will escape via the inlet pipe due to the pressure that has been built up in the compressor element. In this air under high pressure, up to 13 bar, is also found mist from the liquid, in particular oil, which had been injected on the rotors for lubricating, cooling and sealing.

This bringing to a standstill can either be an emergency stop or the normal deactivation of the compressor element.

The liquid is used again, and that is why it is desirable to stop losses of this liquid such as mist via the inlet pipe, and to make them flow back to the compressor element. Moreover, this liquid could have a negative influence on the working of the filter, which is normally erected at the beginning of the inlet pipe, or it could damage this filter.

To this end, compressor elements traditionally comprise an inlet valve in their inlet pipe which is automatically closed when the compressor element is brought to a standstill, so that no air can flow in or out of the compressor element via the suction pipe.

An inlet valve comprises moving parts and is liable to wear. Hence, in the case of a compressor element which is frequently started and stopped, it may be necessary to replace the non-return valve in the inlet pipe from time to time. Moreover, an inlet valve is relatively expensive.

The present invention aims an inlet piece for a liquid-injected compressor element which does not have the above-mentioned disadvantages and which efficiently stops liquid particles but which, as opposed to an inlet valve, has no moving parts and is relatively inexpensive.

This aim is reached according to the invention by means of an inlet piece comprising a sleeve which consists of a casing, a bottom wall provided with an opening and a top wall which is entirely tight, a pipe opening on the inside of the sleeve and a partition comprising a span part which spans the opening in the aforesaid bottom wall, and which transforms into an enclosing part reaching down to the bottom wall, partially enclosing the opening, whereby the partition leaves a passage on one side of the opening and the pipe opens in the sleeve between the top wall and the span part, such that, because of the partition, gas flowing from the opening to the pipe has to make among others a revolving movement.

Thanks to this revolving movement, not only big drops are stopped, but also liquid in the shape of mist particles are stopped.

The enclosing part of the partition preferably only fits up against the casing with one side edge, while the passage between the other side edge and the casing remains open.

The sleeve is preferably cylindrical or has an elliptic section, which promotes the revolving motion of the gas.

The opening in the bottom wall of the sleeve is preferably situated eccentrically.

On the side of the span part, the passage can be limited by an additional partition part connecting onto this span part and extending over a small distance towards the bottom wall.

The passage preferably has a surface which is at least as large as the surface of the section of the pipe.

As a result, the pressure drop in the inlet piece will be low under normal working conditions of the compressor element.

The inlet piece is preferably mounted directly on the inlet of the compressor element. To this end, the inlet piece can be provided with a mounting flange protruding outside the casing, which flange may form a whole with the bottom wall.

In order to better explain the characteristics of the invention, the following preferred embodiment according to the invention is described as an example only without being limitative in any way, with reference to the accompanying drawings, in which.

Figure 1:
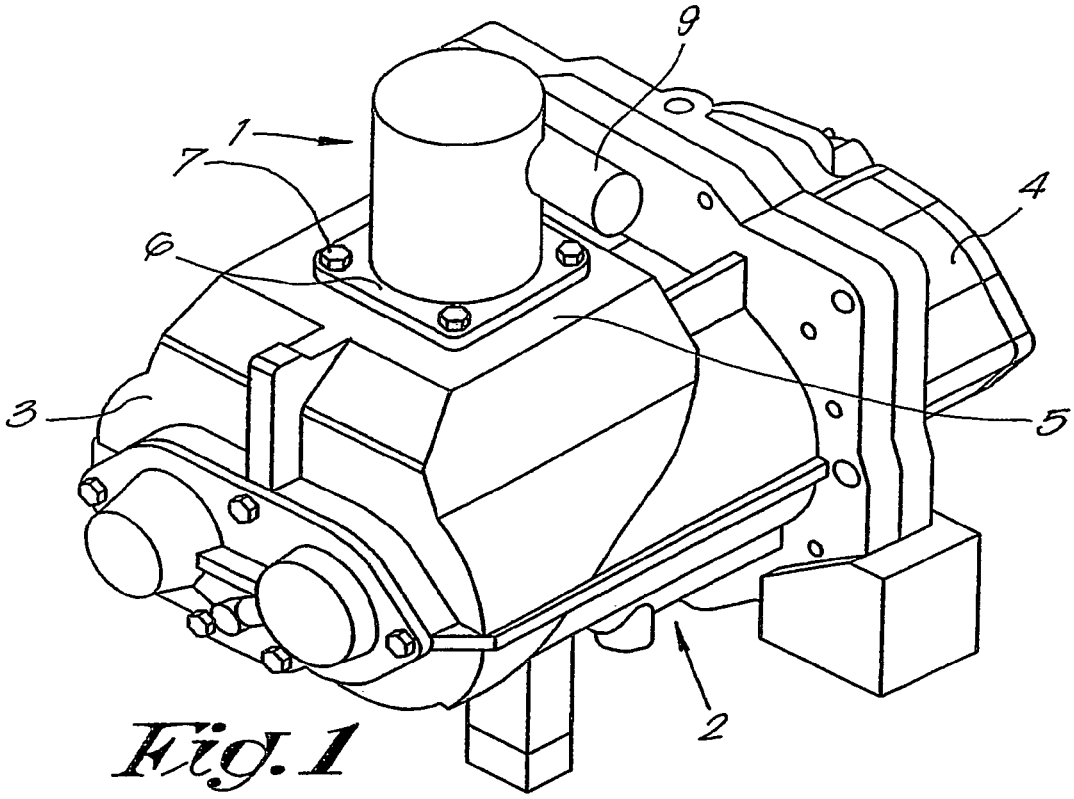
FIG. 1 represents a view in perspective of a compressor element upon which is provided an inlet piece according to the invention.
Figure 2:
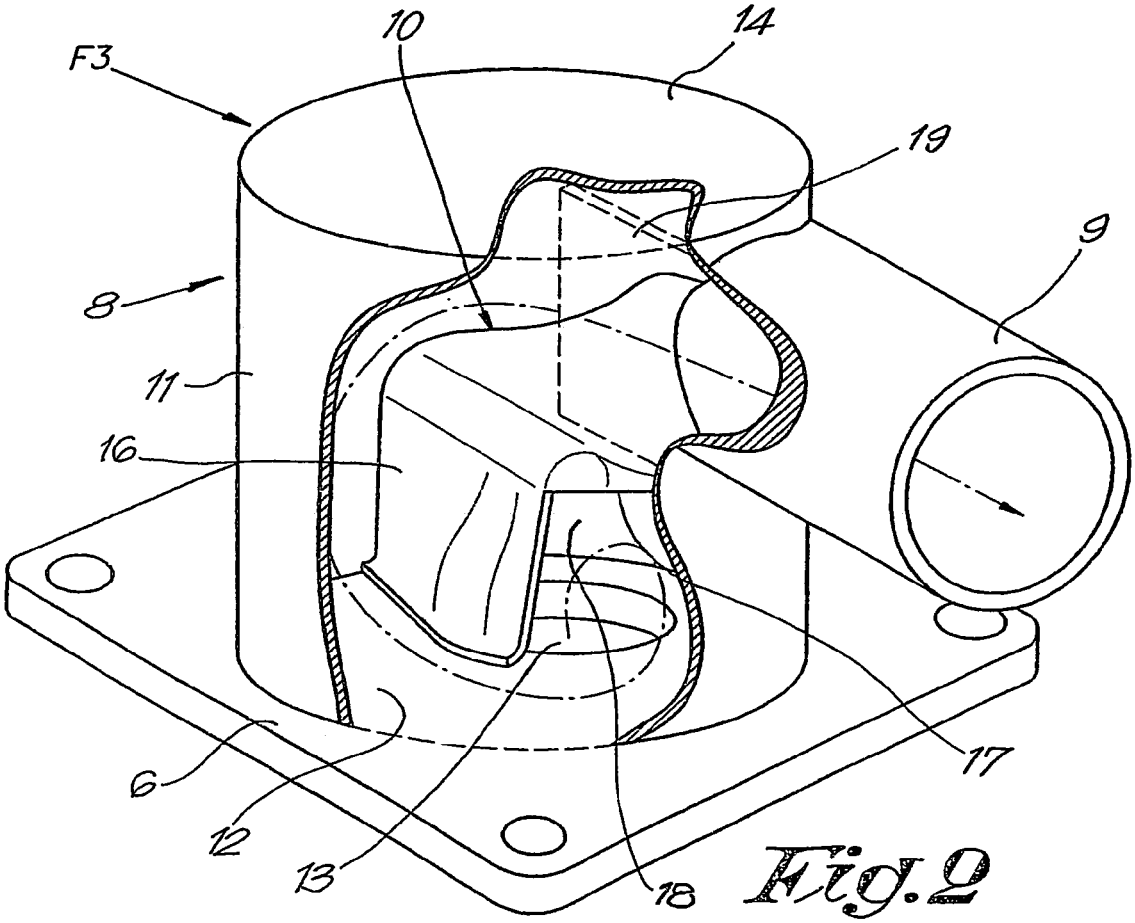
FIG. 2 shows a view in perspective to a larger scale, with a partial cut, of the inlet piece from FIG. 1.
Figure 3:
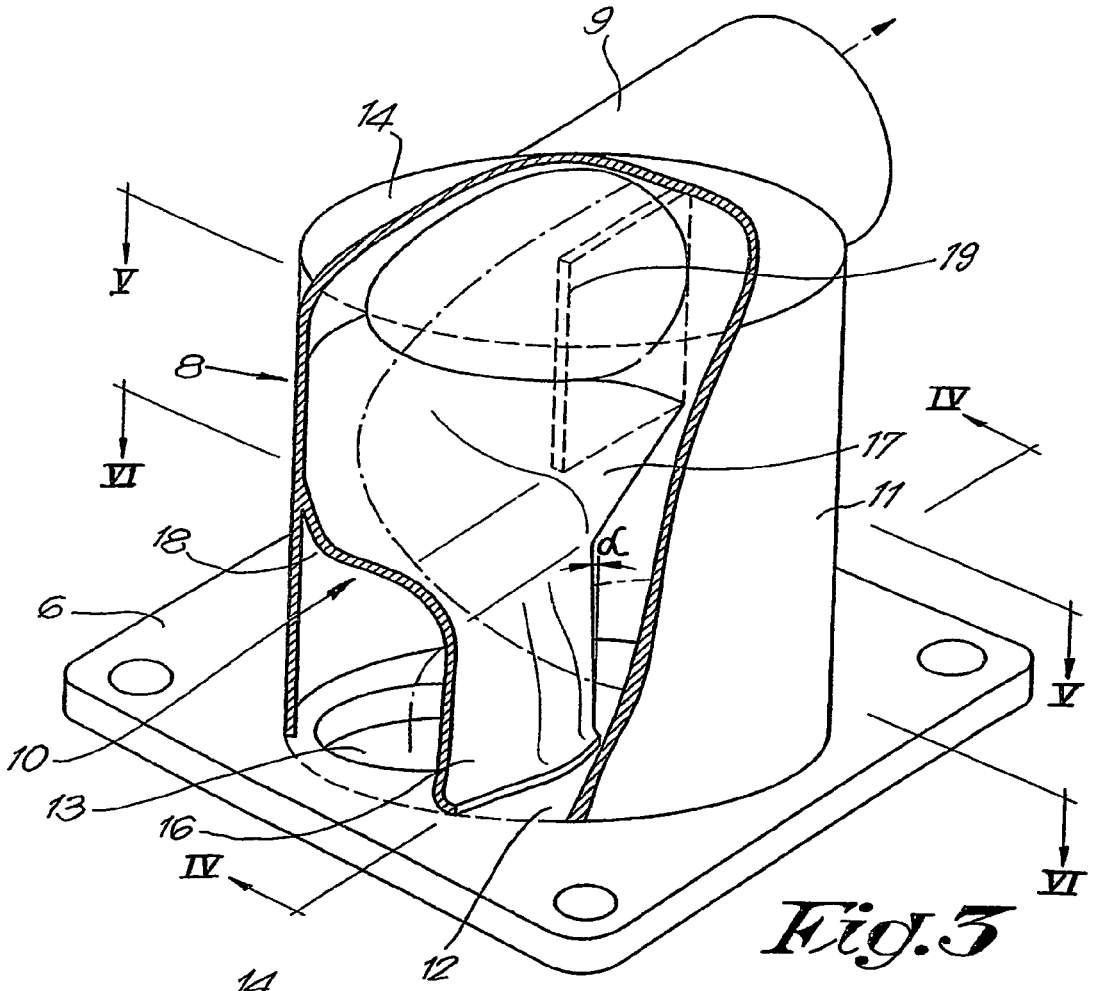
FIG. 3 shows a view in perspective with a partial cut, seen according to arrow F3 in FIG. 2.
Figure 4:
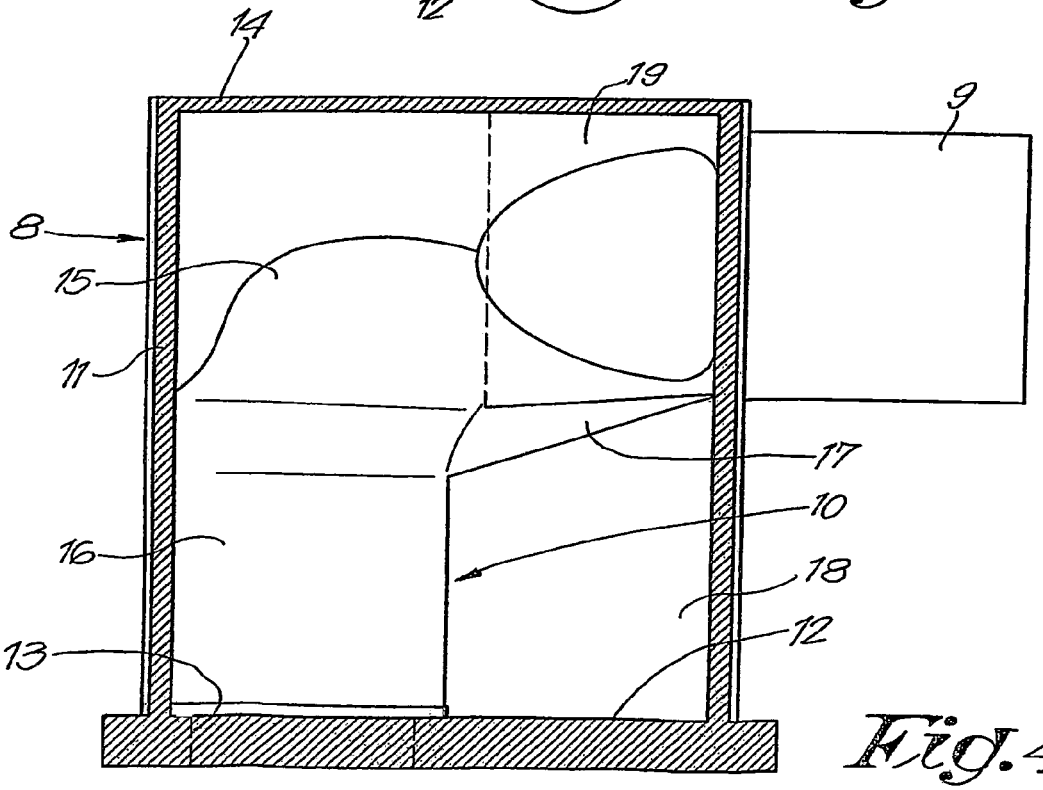
FIG. 4 shows a section according to line IV—IV in FIG. 3.
Figure 5:
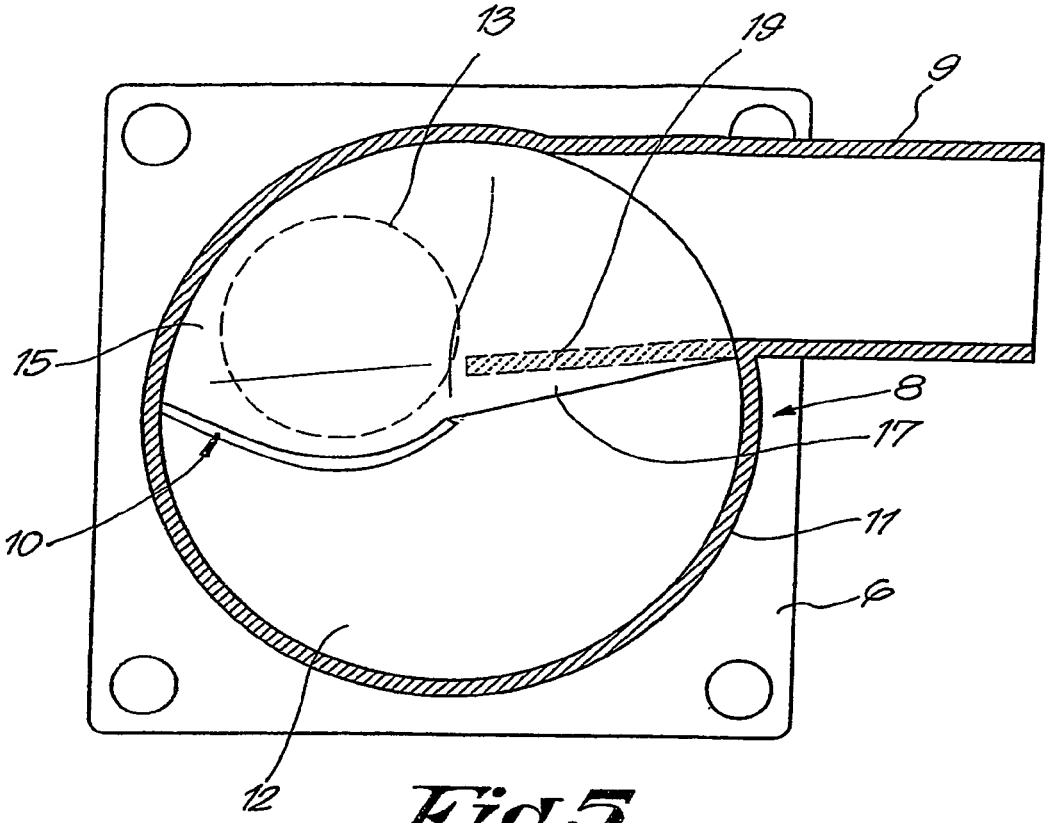
FIG. 5 shows a section according to line V—V in FIG. 3.
Figure 6:
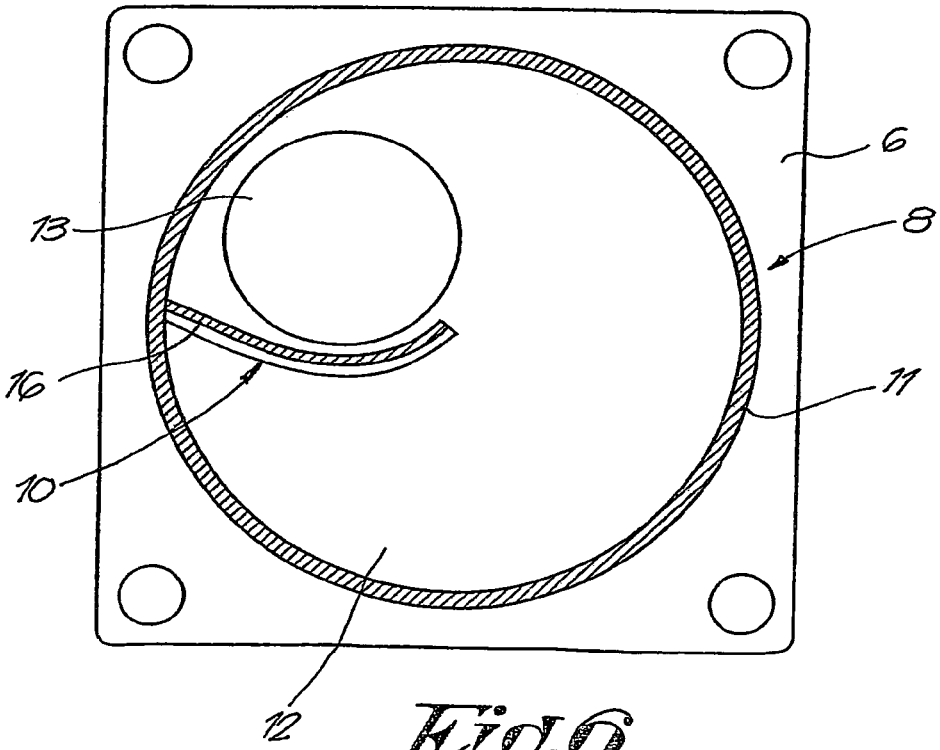
FIG. 6 shows a section according to line VI—VI in FIG. 3.

FIG. 1 represents an inlet piece 1 according to the invention which is mounted directly on the inlet of an oil-injected screw-type compressor element 2. The construction of this compressor element 2 will be sufficiently known to craftsmen and is not represented here or described in detail.

Inside the housing 3 of the compressor element 2 are erected two rotors which are driven by a motor 4, whereby the housing 3 has an exhaust at the bottom onto which is connected a compressed air line and one or several oil injection points which are connected by means of an oil supply line, and which has an inlet at the top.

The inlet of the compressor element 2 has a connecting flange or, as represented in FIG. 1, a flat horizontal part 5 of the housing 3.

The inlet piece 1, which is represented in detail in FIGS. 2 to 6, is provided with a connecting flange 6 with which it is fixed directly onto said flat part 5, above the inlet, by means of bolts 7.

If any directions are mentioned hereafter, they should be seen as of the position of the inlet piece 1 when this is mounted on the part 5.

The inlet piece 1, as represented in the figures, mainly consists of a round, vertical sleeve 8, a horizontal, round pipe 9 connecting onto it, and a partition 10 on the inside with as many round shapes as possible so as to avoid unwanted whirls of the air flow.

The sleeve 8 consists of a cylindrical casing 11, a round bottom wall 12 with a round opening 13 provided eccentrically in it, and a top wall 14 which is entirely tight. If possible, the bottom wall 12 forms a whole with the aforesaid connecting flange 6. If the dimensions of the connecting flange 6 are smaller than the bottom wall 12, an outlet pipe should be mounted between the connecting flange 6 and the bottom wall. The height of this outlet pipe is determined by the height required for mounting the bolts 7. The diameter of the opening 13 preferably coincides with the diameter of the pipe 9.

Onto the pipe 9 is connected an inlet pipe with a filter in it. This pipe 9 connects tangentially onto the sleeve 8, right beneath the top wall 14, whereby the axis of the pipe 9 preferably cuts the vertical through the middle of the opening 13.

The partition 10 consists of a lying span part 15 which spans the opening 13 at the top, but under the exit of the pipe 9, and which transforms fluently in a standing enclosing part 16 reaching down to the bottom wall 12, next to the opening 13, and which partially encloses this opening 13, whereas an additional vertical partition part 17 fits up against the enclosing part 16 at the bottom of the span part 15.

Thus, the pipe 9 opens above said span part 15 in the sleeve 8.

The span part 15 fits up against the casing 11, except on the side of the enclosing part 16. The span part 15 should practically entirely span the opening 13, and the size of this span part 15, diagonally to the enclosing part, is thus determined by the diameter of the opening 13.

Said span part 15 is preferably directed at right angles to the casing 11, and vertically the top side of the span part 15 connects tangentially onto the casing 11.

The enclosing part 16 fits up against the casing 11 with a standing side edge. However, a passage 18 is left between the other standing side edge and the casing 11.

The surface of this passage 18 corresponds to the surface of the opening 13, as a result of which the pressure drop in the inlet piece 1 is restricted.

The enclosing part 16 can be straight, bent, for example circular, or partially straight and partially bent, seen parallel to the bottom wall 12.

This enclosing part 16 will preferably stand at an angle a of for example 10° in relation to the vertical on the bottom wall, and it is preferably bent at the bottom so as to connect horizontally onto the bottom wall 12 so as to provide for a good air conduction and to provide for a good connection of the partition 10 onto the bottom wall 12.

The additional vertical part 17 of the partition 10 connects onto the bottom side of the span part 15, right above the passage 18, and it has the same width as the passage 18, parallel to the bottom wall 12, whereby this part 17 excludes an immediate bypass to the pipe 9.

In order to limit the pressure drop in the inlet piece 1, the distance between the enclosing part 16 and the vertical partition part 17 on the one hand, and the casing 11 on the other hand, is as large or larger than the width of the passage 18, parallel to the bottom wall 12.

For the same reason, the distance between the span part 15 and the top wall 14 is equal to or larger than the diameter of the pipe 9.

The minimal diameter of the inlet piece 1 is determined by the diameter of the opening 13 and the width of the passage 18.

The inlet piece has a low resistance to flow under normal working conditions, and a high resistance to flow when the compressor element is brought to a standstill.

If the flow resistance is low under normal working conditions, there will be few losses when the air flows in. A high flow resistance at the time the compressor element is brought to a standstill makes sure that few oil particles will flow outside through the inlet pipe.

As the span part 15 is at least as wide as the size of the opening 13, the large oil drops will be stopped by said span part 15 above the opening 13.

The smaller oil particles are stopped by the centrifugal force principle. Because of the shape of the partition 10 and partly because the sleeve 8 is cylindrical, or has an elliptic horizontal section according to a variant, the air flow from the compressor element 2 will make a revolving movement. As the pipe 9 is situated above the span part 15, the air also has to make a vertical movement, apart from a horizontal movement.

The additional vertical partition part 17 makes sure that air from the compressor element 2 is lowered first, such that the volume of the sleeve 8 is used entirely. The air flow will then be less apt to escape directly via the pipe 9, but it will first make a revolving movement.

Thus, the inlet piece 1 stops the oil practically entirely as the air flows out, so that an inlet valve is no longer necessary. Yet, the pressure loss due to the suction under normal working conditions of the compressor element 2 will be minimal.

The inlet valve 1 is not restricted to oil-injected compressor elements 1. It can also be applied when other lubrication liquids are injected.

The additional vertical part 17 of the partition 10 is not always necessary.

According to a variant, instead of the partition part 17, or possibly on top of it, the inlet piece has a vertical additional partition 19 standing on top of the span part 15. This additional partition 19 is represented by means of a dashed line in FIGS. 2, 3 and 4.

In the vertical direction of the span part 15, the additional partition 19 reaches up to the top wall 14 and extends in the horizontal direction, more or less in the same direction as the pipe 9, up to the casing 11 on a place situated next to the exit of the pipe 9, on the side where the passage 18 is situated.

This partition 19 will be at least as long as the width of the passage 18.

The distance between the standing free edge of said partition 19 and the opposite part of the casing 11 is at least equal to the width of the passage 18.

The additional part 19 prevents an unwanted direct air flow from the passage 18 to the pipe 9.

The connecting piece 1 is preferably erected vertically, and the outlet of the compressor element 2 will preferably be situated at the top, such that the oil collected in the connecting piece can flow back into the compressor element.

If the compressor element is connected onto an air receiver which is provided with a blow-off device to let the compressed air escape when the compressor element is brought to a standstill, this blow-off device can be connected at the bottom of the inlet piece 1, such that the blowing off takes place via this inlet piece, and oil in the blown-off air is stopped by this inlet piece 1 in the above-described manner.

The present invention is by no means limited to the above-described embodiment given as an example and represented in the accompanying drawings; on the contrary, such an inlet piece can be made in different shapes while still remaining within the scope of the invention.

The invention claimed is:

1. Inlet piece for a liquid-injected compressor element, comprising a sleeve (8) including a casing (11), a bottom wall (12) provided with an opening (13) and a top wall (14) which is entirely tight, a pipe (9) opening on the inside of the sleeve (8) and a partition (10) comprising a span part (15) which spans the opening (13) in the aforesaid bottom wall (12) and which transforms into an enclosing part (16) reaching down to the bottom wall (12), partially enclosing the opening (13), wherein the partition (10) leaves a passage (18) on one side of the opening (13) and the pipe (9) opens in the sleeve (8) between the top wall (14) and the span part (15), such that, because of the partition (10), gas flowing from the opening (13) to the pipe (9) has to make at least a revolving movement.

2. Inlet piece according to claim 1, wherein all edges of the partition (10), except the edges of the passage (18), fit up against the casing (11).

3. Inlet piece according to claim 1, wherein the enclosing part (16) of the partition (10) only fits up against the casing (11) with a side edge, whereas the passage (18) between the other side edge and the casing (11) remains open.

4. Inlet piece according to claim 1, wherein the sleeve (8) is cylindrical or has an elliptic section.

5. Inlet piece according to claim 1, wherein the enclosing part (16) preferably forms an angle $\alpha$ in relation to the vertical on the bottom wall (12).

6. Inlet piece according to claim 1, wherein the opening (13) in the bottom wall (12) of the sleeve (8) is situated eccentrically.

7. Inlet piece according to claim 1, wherein on the side of the span part (15), the passage (18) is limited by an additional partition part (17) connecting onto said span part (15) and extending over a small distance towards the bottom wall (12).

8. Inlet piece according to claim 7, wherein the inlet piece is at least as wide as the size of the opening (13).

9. Inlet piece according to claim 1, comprising an additional partition (19) provided between the span part (15) and the top wall (14) and connecting onto the casing (11) with one edge, wherein said additional partition (19) is at least as long as the passage (18) and prevents gas from flowing directly from the passage (8) to the pipe (9).

10. Inlet piece according to claim 1, wherein the passage (18) has a surface which is at least as large as the surface of the section of the pipe (9).

11. Inlet piece according to claim 1, wherein the distance between the enclosing part (16) and the casing (11 ) of the sleeve (8) is at least as large as the width of the passage (18), measured parallel to the bottom wall (12).

12. Inlet piece according to claim 1, wherein the inlet piece is mounted directly on the inlet of a compressor element (2).

13. Inlet piece according to claim 12, wherein the inlet piece is provided with a mounting flange (6) protruding outside the casing (11), which flange forms a whole with the bottom wall (12).

14. Inlet piece according claim 9, wherein the flange (6) is smaller than the bottom wall (12), and an additional outlet pipe is provided.

15. Inlet piece according to claim 1, wherein the inlet piece is erected vertically, such that the oil collected in the connecting piece can flow back into a compressor element.

* * * * *